US011925224B2

(12) United States Patent
Kurtzweg et al.

(10) Patent No.: US 11,925,224 B2
(45) Date of Patent: Mar. 12, 2024

(54) SPORTS JACKET WITH DEVICE FOR HEAT REGULATION

(71) Applicant: KJUS North America, Inc., Boulder, CO (US)

(72) Inventors: Kenneth Kurtzweg, Oberägeri (CH); Nico Serena, Steinhausen (CH)

(73) Assignee: KJUS North America, Inc., Boulder, CO (US)

( * ) Notice: Subject to any disclaimer, the term of this patent is extended or adjusted under 35 U.S.C. 154(b) by 0 days.

(21) Appl. No.: 14/654,499

(22) PCT Filed: Dec. 5, 2013

(86) PCT No.: PCT/EP2013/075609
§ 371 (c)(1),
(2) Date: Jun. 9, 2017

(87) PCT Pub. No.: WO2014/095379
PCT Pub. Date: Jun. 26, 2014

(65) Prior Publication Data

US 2015/0327608 A1 Nov. 19, 2015

(30) Foreign Application Priority Data

Dec. 19, 2012 (CH) ..... 02864/12

(51) Int. Cl.
*A41D 27/28* (2006.01)
*A41D 3/00* (2006.01)
(Continued)

(52) U.S. Cl.
CPC ..... *A41D 27/285* (2013.01); *A41D 3/02* (2013.01); *A41D 27/28* (2013.01); *A41D 3/00* (2013.01);
(Continued)

(58) Field of Classification Search
CPC ..... A41D 3/00; A41D 3/02; A41D 13/002; A41D 27/285; A41D 2600/10; A41D 27/28
(Continued)

(56) References Cited

U.S. PATENT DOCUMENTS 1,973,419 A * 9/1934 Trageser ..... A41D 27/10 2/115
3,153,793 A * 10/1964 Lepore ..... A41D 3/00 2/108
(Continued)

FOREIGN PATENT DOCUMENTS

AU 9219489 B 7/1993
CN 200930267710.0 11/2010
(Continued)

OTHER PUBLICATIONS

International Search Report, International Application No. PCT/EP2013/075609, Applicant: LK International AG, Date of the actual completion: Apr. 30, 2014.
(Continued)

*Primary Examiner* — Nathan E Durham
*Assistant Examiner* — Abby M Spatz
(74) *Attorney, Agent, or Firm* — Polsinelli PC

(57) ABSTRACT

The sports jacket comprises at least one a closable vent (2) in the forearm region (1) of each sleeve on that side which is determined to lie adjacent to the inner side of the forearm. The vents (2) are each equipped with a zipper. Inside the vents an opening is provided in the lining (7) of the sleeve covered with an air-permeable textile fabric (4). The opening may be framed by a spring-loaded ring profile, which keeps the opening open in its relaxed state and forces it into a slit by way of closing the zipper. Alternatively, said opening is framed by a straight, spring-loaded profile which
(Continued)

Figure 1:
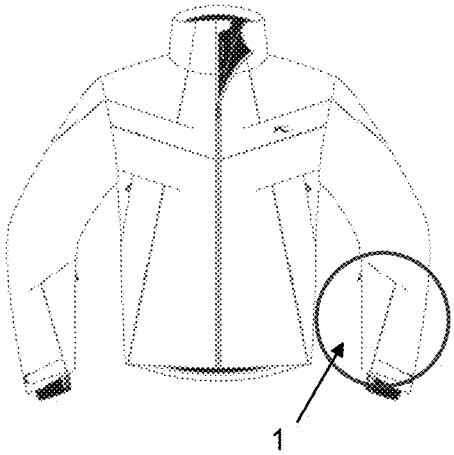

keeps the opening closed in its relaxed state. By means of twisting a turn-lock fastener (5) with pulling cables, the top ends of said profile are being brought closer together to its bottom ends against the spring force, thus spanning the enframed opening.

20 Claims, 3 Drawing Sheets

(51) Int. Cl.
*A41D 3/02* (2006.01)
*A41D 13/002* (2006.01)

(52) U.S. Cl.
CPC ..... *A41D 13/002* (2013.01); *A41D 2600/10* (2013.01)

(58) Field of Classification Search
USPC ..... 2/93, 85
See application file for complete search history.

(56) References Cited

U.S. PATENT DOCUMENTS 5,105,477 A * 4/1992 Golde ..... A41D 27/10 2/108
5,299,323 A * 4/1994 Schaefer ..... A41D 1/06 2/220
5,433,648 A * 7/1995 Frydman ..... A41C 3/0028 2/183
5,570,473 A * 11/1996 Andries ..... A41D 3/00 2/108
5,642,526 A * 7/1997 Thompson ..... A41D 13/02 2/69
5,845,336 A * 12/1998 Golde ..... A41D 27/28 2/108
6,085,353 A * 7/2000 van der Sleesen .... A41D 27/20 2/93
6,263,510 B1 * 7/2001 Bay ..... A41D 27/28 2/108
6,339,845 B1 * 1/2002 Burns ..... A41D 31/102 2/243.1
6,416,074 B1 7/2002 Maravetz et al.
6,792,621 B2 * 9/2004 Braun ..... A41D 27/285 2/1
7,171,695 B2 * 2/2007 Braun ..... A41D 27/28 2/247
7,412,728 B2 * 8/2008 Alesina ..... A41D 27/28 2/69
7,950,112 B2 * 5/2011 Hammerslag ..... A43B 5/16 24/68 SK
7,954,173 B2 * 6/2011 Collier ..... A41D 1/06 2/108
7,966,668 B2 * 6/2011 Bay ..... A41D 27/28 2/93
D704,924 S * 5/2014 Roberts ..... D2/831
9,226,531 B2 * 1/2016 Keathley ..... A41D 3/00
9,301,556 B2 * 4/2016 Koller ..... A41D 3/02
9,357,807 B2 * 6/2016 Berns ..... A41F 19/00
2003/0024028 A1 * 2/2003 Sleesen ..... A41D 27/285 2/2.17
2003/0138586 A1 * 7/2003 Fowler ..... A41D 27/24 428/57
2003/0140399 A1 * 7/2003 Golde ..... A41D 27/28 2/410
2003/0140404 A1 7/2003 Golde
2003/0154536 A1 * 8/2003 Anderson ..... A41D 3/02 2/108
2004/0232267 A1 * 11/2004 Liao ..... B65H 75/4431 242/378.1
2004/0237168 A1 * 12/2004 Braun ..... A41D 27/28 2/93
2005/0172381 A1 * 8/2005 Bush ..... A41D 27/28 2/249
2005/0247813 A1 * 11/2005 Kovacevich ..... A42B 3/08 242/388.6
2006/0277652 A1 * 12/2006 Okajima ..... A41D 13/00 2/93
2006/0277653 A1 * 12/2006 Okajima ..... A41D 3/00 2/93
2008/0263743 A1 * 10/2008 Maurer ..... A41D 27/28 2/69
2009/0077710 A1 * 3/2009 Bay ..... A41D 27/28 2/87
2010/0139057 A1 * 6/2010 Soderberg ..... A43C 11/16 24/68 R
2011/0072566 A1 * 3/2011 Kovacevich ..... A41D 15/00 2/463
2012/0017346 A1 * 1/2012 Reimer ..... A41D 27/28 2/69
2012/0117709 A1 * 5/2012 Damon ..... A44B 19/02 24/429
2013/0203319 A1 * 8/2013 Torres ..... A41C 3/0057 450/59

FOREIGN PATENT DOCUMENTS

CN 202286377 U 7/2012
DE M9406216-0043 1/1995
DE 29701974 U1 6/1998
DE 10261359 7/2004
DE 10261359 A1 7/2004
DE 10261359 B4 2/2007
EP 1518472 A1 3/2005
FR 050820-0008 7/2005
WO 99/42010 A1 8/1999
WO 2003006234 A1 1/2003

OTHER PUBLICATIONS

International Preliminary Examination Report, Application No. PCT/EP2013/075609, Applicant: LK International AG, dated Mar. 26, 2015, pp. 1-3.
Jacket Outstars RO888, Oct. 27, 2010, Amazon Germany and Amazon UK, https://www.amazon.de/Outstars-RO-888-Outdoorjacke/dp/B0049ELMDC.
Using motorcycle gear as snow ski gear, Adventure Rider, Jan. 14, 2010, http://advrider.com/index.php?threads/using-motorcycle-gear-as-snow-ski-gear.541578/.
BOA Technology website, Nov. 13, 2012, Boatechnology.com, https://web.archive.org/web/20121113094912/https://www.boatechnology.com.
Goldwin 2009 catalogue, Jan. 2009, front cover, pp. 5, 6 &30, Japan.
Manufacturing drawings of vest GSM12901, Sep. 19, 2008 and Apr. 23, 2008, Japan.
Excerpt from 2ch.live blog, Nov. 24, 2009, p. 23, https://2ch.live/cache/view/bike/1258663508.
GWS Neo Euro Cyclone, Goldwin website, Mar. 24, 2009, Japan, https://web.archive.org/20090324010352/http://www.goldwin.co.jp/gw/motorcycle/09ss/product/jackt/12901/index.html.
Blog, Goldwin GSM12901, Jun. 4, 2009, http://858.at.webry.info/209906/article_4.html.
EP Opposition to EP2934208B1, Jan. 19, 2018.
Decision of Opposition of Patent No. EP2934208 mailed Jul. 11, 2019.
The Visual Dictionary—Unisex Jackets retrieved Mar. 12, 2020.
Wikipedia Article Ski Jacket retrieved Mar. 16, 2020.
Wikipedia Article—Trunk Torso (anatomy) retrieved Apr. 1, 2020.
Wikipedia Picture of Torso (anatomy) retrieved Mar. 13, 2020.
Dictionary—Ski Jacket retrieved Mar. 31, 2020.
"Lexikon Technische Textilien"; Fabia Denninger (Hrsg.); 2009; pp. 4-9, 266, 267, 464-467.
Textil-Und Modelexikon; Fabia Denninger and Elke Giese; 2006; pp. 4, 5, 256, 257, 334 and 335.
Venkatraman, Hayes; Materials and Technology for Sportswear and Performance Apparel; pp. 164-165; 2016.

(56) References Cited

OTHER PUBLICATIONS

Wikipedia; Motorcycle Personal Protective Equipment; retrieved from https://en.wikipedia.org/wiki/Motorcycle_personal_protective_equipment, Nov. 14, 2011.

Wikipedia; Units of Textile Measurement; retrieved from https://en.wikipedia.org/wiki/Units_of_textile_measurement, Nov. 29, 2012.

Snowheads Ski Forum; retrieved from https://snowheads.com/ski-forum/viewtopic.php?t=20529, Apr. 17, 2020.

"Lasche | Übersetzung Englisch-Deutsch" Dict.cc, Deutsch-Englisch-Wörterbuch, accessed Mar. 16, 2022 https://www.dict.cc/?s=Lasche.

"Reiter | Übersetzung Englisch-Deutsch" Dict.cc, Deutsch-Englisch-Wörterbuch, accessed Mar. 16, 2022 https://www.dict.cc/?s=Reiter.

"Zipper" Wikipedia, Wikimedia Foundation, Nov. 16, 2021 https://en.wikipedia.org/w/index.php?title=Zipper&oldid=1055554464.

"Es zeigt Figur 1 eine Sportjacke . . . auf englisch" Google translate to English, accessed Mar. 16, 2022 https://www.google.com/search?q=Es+zeigt+Figur+1+eine+Sportjacke.

"Motorcycle clothes —> Ski clothes?" snowHeads ski forum, accessed Mar. 16, 2022 https://snowheads.com/ski-forum/viewtopic.php?t=20529.

"Unisex Jackets (1 of 2)" The Visual Dictionary, Colume 6: Clothing, accessed Mar. 12, 2020 https://web.archive.org/web/20121030203059/http:/infovisual.info/06/025_en.html.

"ski jacket" English-French Dictionary WordReference.com. accessed Mar. 31, 2020 https://web.archive.org/web/20110613153407/https:/www.wordreferen . . . .

"Bernoulli's principle" Wikipedia, Wikimedia Foundation, Feb. 20, 2022 https://en.wikipedia.org/w/index.php?title=Bernoulli%27s_principle&oldid=1073050262.

Mateus Dias Ribeiro, "Example of 2D non-uniform steady laminar channel flow around a cylinder" ResearchGate, accessed Mar. 17, 2022 https://www.researchgate.net/figure/Example-of-2D-non-uniform-steady . . . .

* cited by examiner

SPORTS JACKET WITH DEVICE FOR HEAT REGULATION

This invention relates to a sports jacket with equipment for an improved regulation of the jacket wearer's heat balance. This jacket is particularly suitable for skiing and equally suitable for all other outdoor activities where the jacket wearer is physically active to a greater or lesser extent over time, while being exposed to relative wind or wind otherwise.

Conventional sports jackets generally don't possess any special equipment accounting for varying dissipation of body heat. They are made to provide warmth and to repel wind and water. A sports jacket however is for the purpose of doing sports. The latter involves physical effort which requires a different body-heat balance compared to that in periods of rest. In order to dissipate heat the sportsman perspires. Poorly and unfavorably designed jackets easily lead to a build-up of heat. Humidity and sweat gathers in the inner lining of the jacket. When the body of the jacket wearer becomes inactive again he or she will soon freeze because evaporation of sweat requires heat. This heat of evaporation is drained from the body. In order to regulate heat dissipation, a central zipper is provided in the jacket extending from top to bottom across the torso. This zipper may be opened to a greater or lesser extent, mostly top-down and sometimes bottom-up. This however immediately causes an air draft which exceedingly cools the torso's front side, which is not only inconvenient but also inefficient as cooling takes place at the wrong place.

For this reason improved sports jackets are equipped with vents which may be opened or closed e.g. by use of snap fasteners or zippers. The vents are intended to provide cool air to those parts of the upper body where the heat accumulates, while minimizing air draft. Thus, in most cases such vents are arranged in the side parts of the jacket facing the torso or near the area facing the armpit. Yet still, cooling remains inadequate and most often also insufficiently adjustable. What is more, the torso comes into contact with cool air which causes local cooling, as opposed to balanced cooling. Local cooling e.g. near the kidney area can have harmful consequences. More generally, the cooling effect should not occur in the torso area beneath which the organs are located, neither in the lung area as is the case when a front zipper is opened, nor in the area close to the digestive tract, i.e. in the abdominal or pelvic area.

To this day no jacket is known which indeed provides for efficient, wholesome and finely adjustable cooling, and in particular no such sports jacket is known which is suitable for strongly varying physical activity over time. Notably skiers are thus affected, being exposed to cold wind when sitting virtually motionless on a chairlift, and thereafter quickly increasing body warmth when skiing jauntily down a slope, which involves high physical activity. The skier then perspires in order to cool, where sweat is given off to his undergarment which absorbs the sweat and gets moist. Eventually also the inner lining of the sports jacket becomes moist. When the skier takes the chairlift thereafter, he or she feels the evaporation chill of the evaporating sweat draining heat from his or her upper body, in addition to the heat dissipation owing to low ambient temperature and wind. Due to the lack of bodily activity, the heat supply is insufficient. Due to these effects conventional sports jackets are underwhelming in their performance. The cooling and thermoregulation allowed by conventional jackets is insufficient and not wholesome.

It is the object of the present invention to provide a sports jacket allowing for substantially improved, demand-based cooling, where in the first place the cooling is to be effected wholesomely, which cooling may moreover be quickly and conveniently adjusted by the jacket wearer on demand and which cooling may be finely adjusted over a wide range of possibilities.

This object is solved by a sports jacket according to the first portion of claim 1 and its characterizing portion.

The drawings below illustrate various embodiments of the sports jacket. By reference to these drawings the sports jacket will be described and its functional principle for providing adjustable cooling also will be explained.

Figure 3:
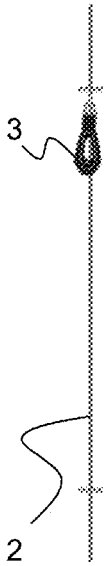
Figure 4:
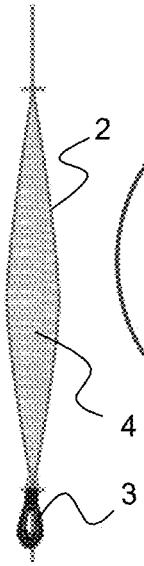
Figure 2:
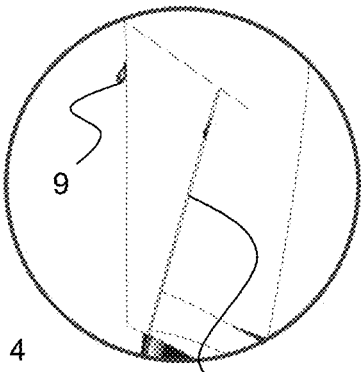
Figure 5:
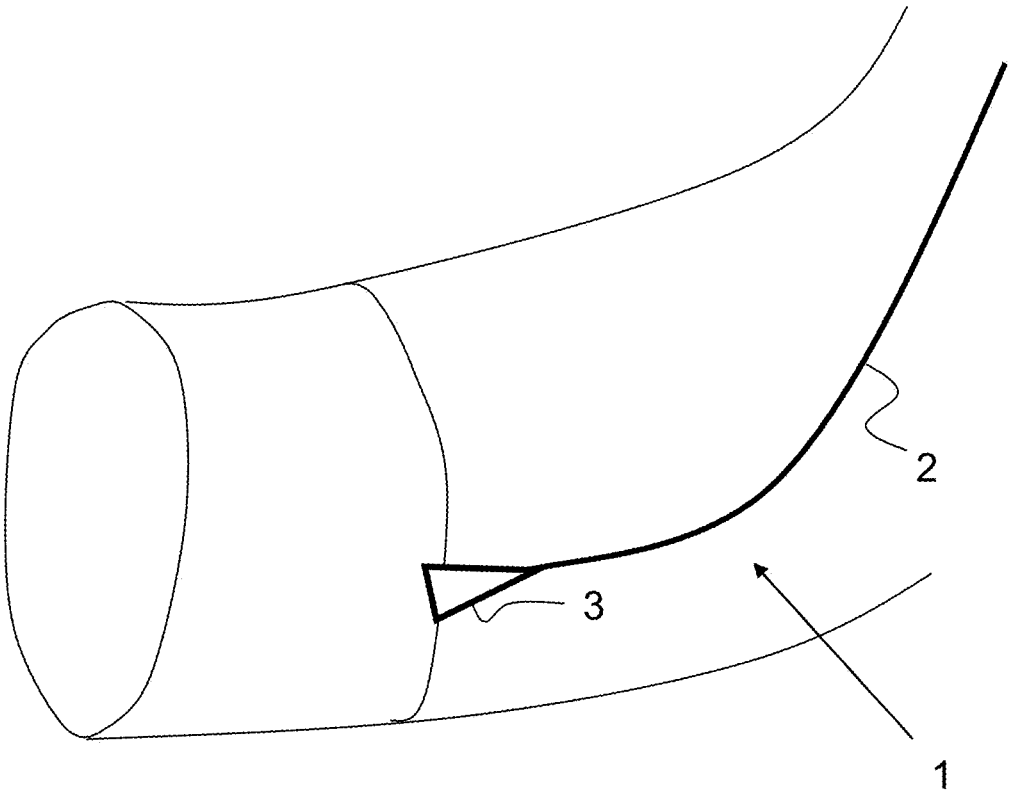
Figure 6:
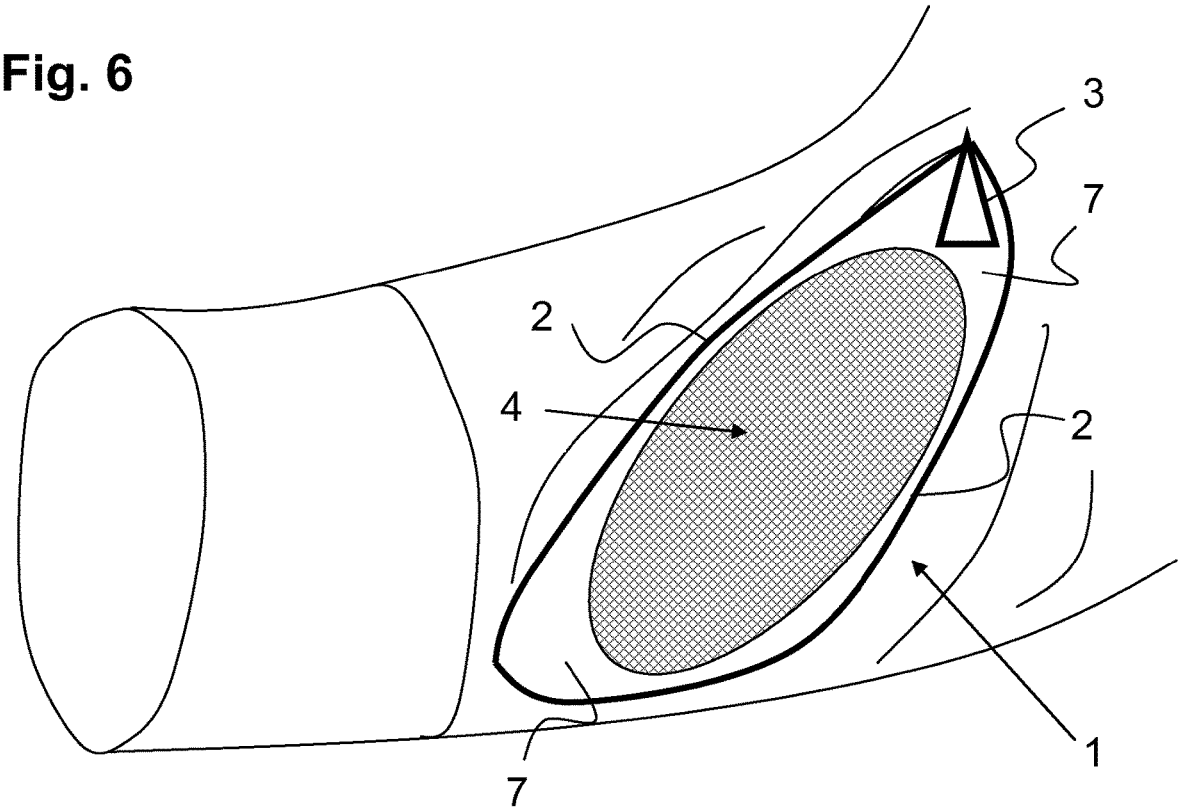
Figure 7:
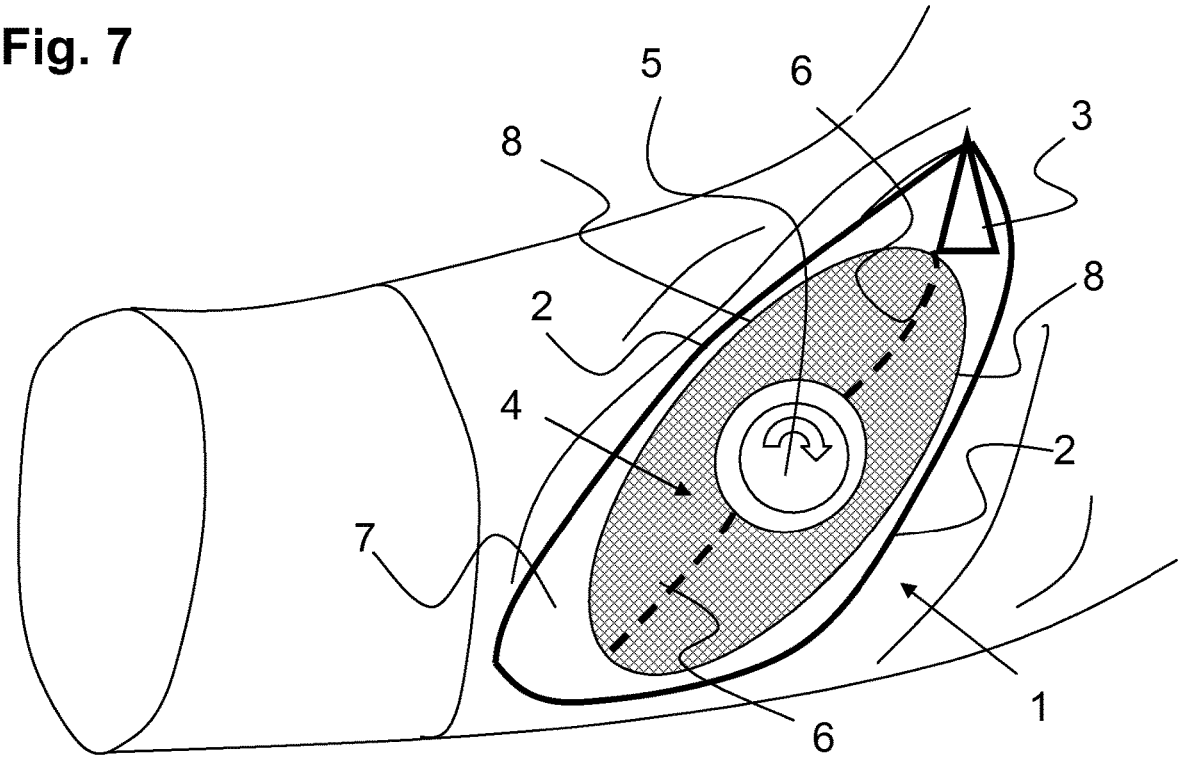
Figure 8:
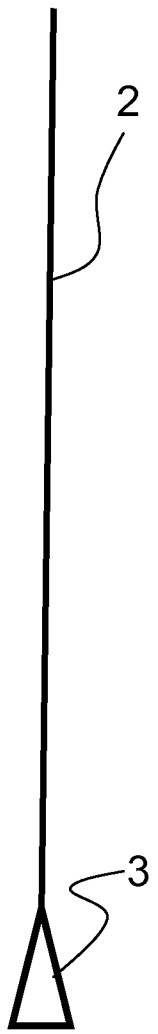
Figure 9:
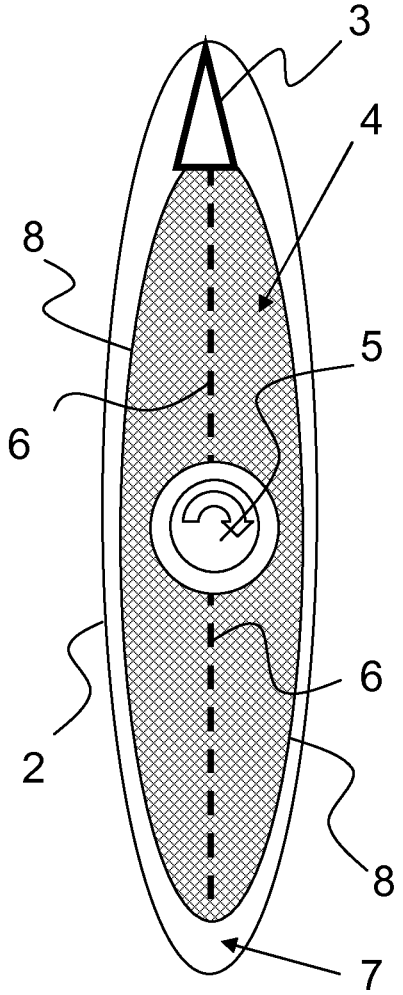
Figure 10:
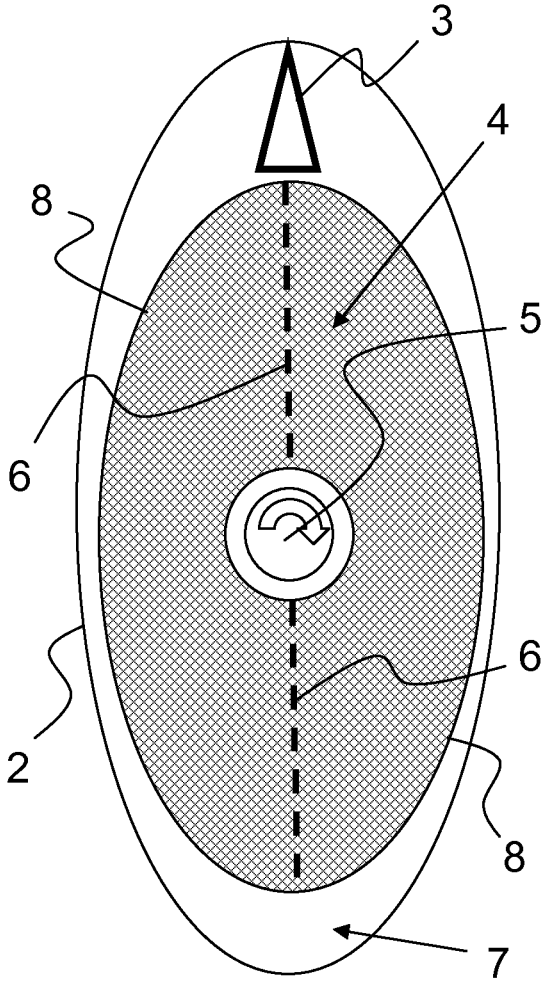

It is shown by:

FIG. 1: A sports jacket embodied as a ski jacket in a front view, the jacket shown with closed vents;

FIG. 2: An enlarged front view of the forearm area of the ski jacket of FIG. 1 with closed vent;

FIG. 3: A closed, inactive vent;

FIG. 4: An open, active vent;

FIG. 5: The forearm area of a sports jacket with closed vent;

FIG. 6: The forearm area of the sports jacket of FIG. 5 with open vent;

FIG. 7: The forearm area of the sports jacket of FIG. 5 with equipment for keeping the vent open, the jacket shown with open vent;

FIG. 8: A closed vent with integral equipment for keeping a vent open;

FIG. 9: The vent of FIG. 8 halfway opened;

FIG. 10: The vent of FIG. 8 fully opened.

FIG. 1 shows a sports jacket embodied as a ski jacket in a front view. The jacket reveals all features common to conventional ski jackets, i.e. a central zipper, a collar and two sleeves. The special feature of this jacket is the way the cooling, i.e. the heat dissipation of the jacket wearer, is effected. To this end, the jacket's forearm area is specially designed, i.e. the area as indicated by circle 1.

FIG. 2 shows area 1 of FIG. 1 in an enlarged view. A zipper with a pull tab 9 extends along the upper inner side of the forearm part of the sleeve. This zipper assembly is part of the inside pocket in which e.g. a ski pass can be deposited. The essential feature for cooling however is the openable and re-closable vent 2. The vent 2 extends along the inner side of the jacket's lower sleeve that covers the inner forearm of the jacket wearer. The vent thus comes to lie precisely adjacent to the inner side of the wearer's forearm where the body's heat dissipation is most efficient. Here, the vent comprises a zipper which is easily operable with the hand of the other arm.

FIG. 3 shows the closed vent 2 on the jacket's right sleeve. Featured is a zipper with a pull tab 3 for operating said zipper, where the pull tab as shown here buts against the upper stop of the vent. For opening the vent, pull tab 3 is pulled down, i.e. towards the sleeve's opening.

FIG. 4 illustrates the vent 2 in the opened configuration, i.e. when it is active for cooling. The zipper pull tab 3 abuts against the bottom stop of the zipper and the vent 2 forms an opening. This opening is here covered by an air-permeable textile fabric 4. With the open vent 2 the airflow streams along the opening such that air comes into contact with the skin underneath said air-permeable textile fabric 4 on the inner side of the forearms. Trial and error have revealed that the inner sides of the forearm is the body's most temperature-sensitive parts due to the fact that a large portion of dissipated heat is released through the inner forearms when maintaining body's heat balance. There, more than any-where else in the body, blood vessels are located directly and only slightly below the surface of the skin. As a result, cold is initially felt by a person on the inner sides of the forearms, provided the latter are uncovered and thus bare. Hence, body heat is most efficiently released to ambient air at this place. This is also the reason why one rolls up the sleeves of a shirt, long-sleeved T-shirt or sweater when one feels warm, as it quickly cools and soon produces relief. On the other hand, if only the front zipper of a ski jacket is partly opened when skiing, body cooling is inefficient and moreover the risk of an inflammation of the bronchia and respiratory system increases due to local hypothermia. Furthermore, local cooling of the torso sides proves to be inefficient and inappropriate. In doing so, cooling is accomplished only locally. Moreover, it is almost impossible for the body to release heat near the kidney area. What is more, heat release from the torso sides beneath the shoulders is undesirable. For one thing, it is inconvenient and for another thing, it has adverse effects from a medical point of view, as the cooling is local and too close to organs such as lungs, liver or kidneys. Despite all this, conventional sports jackets are equipped with vents only in the area of the torso, if at all.

The present sports jacket is the first to be implemented based on the realization that a substantial part of the body's heat exchange occurs on the inner side of the forearms where the blood vessels are located closest to the body surface. Accordingly, the vents 2 are arranged in the inner forearm-area of the sleeves, as shown in FIG. 1.

The vents may be designed in various ways, e.g. round, square, oval or elongate. Likewise, the technical embodiment for opening and closing the vents 2 can be implemented in many ways. In a most simple embodiment the vents 2 are provided with at least one slit in the lower area 1 of the sleeves, i.e. adjacent to the inner sides of the forearms of the jacket wearer. This slit is openable and re-closable by means of a zipper. In the opened configuration the slit reveals an opening within the sleeve's inner lining fabric being covered with an air-permeable textile fabric 4 such that airflow can stream across the air-permeable textile fabric 4. Depending on how far the zipper is opened, air streams across the air-permeable textile fabric 4 to a greater or lesser extent.

FIG. 5 shows a view of the lower sleeve area of such sports jacket with a vent 2 which is arranged at oblique angle to a length of the lower sleeve. Visible is the zipper's pull tab 3 by pulling of which the vent 2 is opened. In the embodiment shown the pull tab 3 is located near the sleeve opening corresponding to the closed configuration of said vent 2. To open the vent, pull tab 3 is pulled back from the sleeve opening. FIG. 6 shows the lower area 1 of said sleeve with the vent 2 fully unzipped, such that the pull tab 3 of the zipper slider abuts against the upper zipper stop. The open vent 2 reveals a view of the inner lining 7 of the sleeve. The inner lining 7 has an opening covered with air-permeable elastic textile fabric 4. Thus, when desired, the airstream—as will be the case with the sports jacket embodied as a ski jacket—will stream across the textile fabric 4 of said opening and heat will be released via this opening, accordingly. Regulation of heat dissipation is effected in a most easy and convenient manner, by opening the zipper to a greater or lesser extent using the hand of the opposite arm. For this purpose the pull tabs 3 are large enough to be grabbed with thick gloves, such that the zipper can be operated easily, conveniently and quickly wearing such gloves.

FIG. 6 lacks equipment to ensure that the vent 2 remains open upon opening the zipper, i.e. to prevent the opening of the inner lining from being partially covered by a loosely formed slot. Such can be prevented by bordering the opening comprising the air-permeable elastic textile fabric 4 by means of a spring-loaded plastic ring or a ring made of spring steel. This ring then borders the opening's rim in the fashion of a hemstitch seam which is sewn-in to the textile fabric. Thus, in an untensioned state the ring forces open the vent's opening in the inner lining, such that it takes a form as shown here. The extent to which the zipper is opened determines the size of said opening. By closing the zipper the spring profile is forced against its spring force into an elongate form or into a boat-shaped form.

A further advanced embodiment is shown in FIG. 7. According to this embodiment a turn-lock fastener 5 with pulling cables 6 leading to both ends of the zipper is attached to the opening. To date, such turn-lock fasteners 5 are primarily used with bicycle helmets. Along the borderline 8 of the opening covered with the air-permeable elastic textile fabric 4 two profiles capable of elastic bending are sewn-in, said profiles being made of spring steel or of a synthetic material. The profiles are sewn-in e.g. by way of a hemstitch seam. When the vents are closed the two untensioned profiles run almost parallel. Contrasting the previously described embodiment, the profiles capable of elastic bending keep the opening closed when they are in an untensioned state. If however the turn-lock fastener 5 is turned following the direction indicated by the arrow, the pulling cables 6 are pulled each towards the turn-lock fastener 5, thus pulling together both ends of the opening which initially had the shape of a slit. Even when wearing thick gloves this may be easily accomplished. Accordingly, the opening changes its form from slit-shaped to oval and eventually to circular owing to the elastic bending of the sewn-in profiles. The surface exposed by the opening increases, respectively. In order to decrease this surface, the turn-lock fastener 5 is turned in the opposite direction, i.e. counterclockwise, by the turning of which the pulling cables 6 elongate due to the spring force of the sewn-in profiles, thereby closing the opening.

FIGS. 8 to 10 schematically depict said process of opening and closing. In FIG. 8 the zipper is closed and likewise the vent 2. The pull tab 3 of the zipper slider has been pulled down to abut the lower stop of the vent 2. In FIG. 9 the pull tab 3 has been pulled to the upper stop of the vent 2. The zipper is thus fully opened. However, the opening comprising the air-permeable textile fabric 4 is only partially open. The spring profiles capable of elastic bending, which are arranged along the borderline 8 of the opening tend to keep the border 8 straight and are but partially bent, as the pulling cables 6 have tightened upon minor turning of the turn-lock fastener 5. The area exterior to the opening is part of the inner lining 7 of the sports jacket's sleeve. FIG. 10 illustrates the embodiment when the turn-lock fastener 5 has been further turned, thus further tightening the pulling cables 6. This has caused the opening's borderline 8 to further bend against the spring force of the inlaying spring profiles. The pulling cables 6 thus span the opening and keep it securely in its open configuration. Hence, by turning the turn-lock fastener 5 the size of the area of the opening may be chosen freely and smoothly from any size between maximum aperture and complete closure. Optimum cooling required by the circumstances may be achieved quickly. Typically, the zipper of the vent 2 will be closed when a skier is accommodated on a chairlift or ski lift. Reaching the terminal station at the top, he or she opens the zippers of the vent with two swift movements of the hand for adjusting the openings. Depending on temperature and skiing habits, the openings covered with the air-permeable textile fabric 4 may be opened to a greater or lesser extent by turning the turn-lock fasteners accordingly. It is clear that all embodiments may be equally implemented with more than one vent in each sleeve of the sports jacket.

What is claimed is:

1. A ski jacket configured to be worn when skiing, comprising:

a torso region, including a collar and a central zipper;

wherein the ski jacket is configured for a varying physical activity level of a skier wearing the ski jacket and for a varying demand of heat dissipation over time, the ski jacket further comprising:

two sleeves connected to the torso region, each of the two sleeves having a top connected to the torso region, a bottom opposite the top, and two sides provided between the top and the bottom, wherein each of the two sleeves is configured such that the skier's forearm is located in a lower portion of the sleeve toward the bottom when the skier's arm is placed within the sleeve, wherein each of the two sleeves is provided with only one vent, the vent being openable from a closed state into an open state and closeable from the open state to the closed state, the vent forming an opening that is framed by spring-loaded profiles, wherein each side of the opening is provided with a spring-loaded profile comprising a material capable of elastic bending, wherein the spring-loaded profiles in an untensioned state keep the opening closed, and the vent being provided in the lower portion of each of the two sleeves and on a side of the sleeves which is configured to lie adjacent to one or more inner sides of the skier's forearms when the skier's arms are placed within the sleeves, to allow air to stream across the vent to a greater or lesser extent depending on how far the vent is opened, thereby effectively releasing body heat to ambient air via the vent, wherein the vent provided on each of the two sleeves is configured to not extend into the torso region of the jacket to avoid heat release from one or more sides of the skier's torso, and wherein a cuff is provided at the bottom of each sleeve and wherein the vent provided on each of the two sleeves is arranged at a distance from the cuff; and a turn-lock fastener with pulling cables arranged on opposing portions of the turn-lock fastener, wherein the turn-lock fastener is configured to activate or engage the pulling cables when twisted to bring one or more top ends of the spring-loaded profiles and one or more bottom ends of the spring-loaded profiles closer together against a spring force of the spring-loaded profiles, thereby forcing open the opening framed by the spring-loaded profiles.

2. The ski jacket according to claim 1, wherein the opening formed by the vent is covered by an air-permeable, elastic textile.

3. The ski jacket according to claim 1, wherein the vent provided on each of the two sleeves is configured to transition between the open state and the closed state based on an amount of tension in the spring-loaded profiles.

4. The ski jacket according to claim 1, wherein each of the vents is arranged along an oblique axis with respect to a length of the lower portion of each sleeve.

5. The ski jacket according to claim 1, wherein each of the vents is equipped with a zipper for opening or closing the vent.

6. The ski jacket according to claim 1, wherein the vent provided on each of the two sleeves is located entirely within the lower portion of the sleeves.

7. The ski jacket according to claim 1, wherein the spring-loaded profiles are configured to keep said opening open when in a tensioned state.

8. The ski jacket according to claim 1, wherein the spring-loaded profiles in the untensioned state have a slit configuration.

9. The ski jacket according to claim 1, wherein the opening is configured to facilitate a transfer of thermal energy directly between (i) an environment external to the ski jacket and (ii) a bloodstream extending along the skier's forearm.

10. The ski jacket according to claim 1, wherein the opening has a round shape, an oval shape, an oblong shape, or a square shape.

11. The ski jacket according to claim 1, wherein the spring-loaded profiles comprise a springy plastic ring or a ring made of a spring steel.

12. The ski jacket according to claim 1, wherein the turn-lock fastener is configured to (i) open the opening when operated in a first direction and (ii) close the opening when operated in a second direction.

13. The ski jacket according to claim 1, wherein the turn-lock fastener is configured to change a size or a shape of the opening.

14. The ski jacket according to claim 1, wherein the turn-lock fastener is configured to tension the pulling cables so that the pulling cables counteract the spring force in order to open the opening.

15. The ski jacket according to claim 1, wherein the turn-lock fastener is configured to release tension in the pulling cables so that the pulling cables elongate under the spring force, thereby allowing the opening to close.

16. A ski jacket configured to be worn when skiing, comprising:

a torso region, including a collar and a central zipper;

wherein the ski jacket is configured for a varying physical activity level of a skier wearing the ski jacket and for a varying demand of heat dissipation over time, the ski jacket further comprising:

two sleeves connected to the torso region, each of the two sleeves having a top connected to the torso region, a bottom opposite the top, and two sides provided between the top and the bottom, wherein each of the two sleeves is configured such that the skier's forearm is located in a lower portion of the sleeve toward the bottom when the skier's arm is placed within the sleeve, wherein each of the two sleeves is provided with only one vent, the vent being openable from a closed state into an open state and closeable from the open state to the closed state, the vent forming an opening that is framed by spring-loaded profiles, wherein each side of the opening is provided with a spring-loaded profile comprising a material capable of elastic bending, wherein the spring-loaded profiles in an untensioned state keep the opening closed, and the vent being provided in the lower portion of each of the two sleeves and on a side of the sleeves which is configured to lie adjacent to one or more inner sides of the skier's forearms when the skier's arms are placed within the sleeves, to allow air to stream across the vent to a greater or lesser extent depending on how far the vent is opened, thereby effectively releasing body heat to ambient air via the vent, wherein the vent provided on each of the two sleeves is configured to not extend into the torso region of the jacket to avoid heat release from one or more sides of the skier's torso, and wherein a cuff is provided at the bottom of each sleeve and where the vent provided on each of the two sleeves is arranged at a distance from the cuff; and a turn-lock fastener with pulling cables arranged on opposing portions of the turn-lock fastener, wherein the turn-lock fastener is configured to activate or engage the pulling cables when twisted to bring one or more top ends of the spring-loaded profiles and one or more bottom ends of the spring-loaded profiles closer together against a spring force of the spring-loaded profiles, thereby forcing open the opening framed by the spring-loaded profiles.

17. The ski jacket according to claim 16, wherein the vent provided on each of the two sleeves is located entirely within the lower portion of the sleeves.

18. The ski jacket according to claim 16, wherein the vent is configured to expose an air permeable textile when opened, wherein the air permeable textile is integrated with an inner lining of each of the two sleeves.

19. A ski jacket configured to be worn when skiing, comprising:

a torso region, including a collar and a central zipper;

wherein the ski jacket is configured for a varying physical activity level of a skier wearing the ski jacket and for a varying demand of heat dissipation over time, the ski jacket further comprising:

two sleeves connected to the torso region, each of the two sleeves having a top connected to the torso region, a bottom opposite the top, and two sides provided between the top and the bottom, wherein each of the two sleeves is configured such that the skier's forearm is located in a lower portion of the sleeve toward the bottom when the skier's arm is placed within the sleeve, wherein each of the two sleeves is provided with at least one vent, the at least one vent being openable from a closed state into an open state and closeable from the open state to the closed state, and the at least one vent being provided in the lower portion of each of the two sleeves and on a side of the sleeves which is configured to lie adjacent to one or more inner sides of the skier's forearms when the skier's arms are placed within the sleeves, to allow air to stream across the at least one vent to a greater or lesser extent depending on how far the at least one vent is opened, thereby effectively releasing body heat to ambient air via the at least one vent, wherein the at least one vent is configured to not extend into the torso region of the jacket to avoid for avoiding heat release from one or more sides of the skier's torso, and wherein the at least one vent forms an opening that is framed by spring-loaded profiles, wherein each side of said opening is provided with a spring-loaded profile comprising a material which is capable of elastic bending, wherein the spring-loaded profiles in an untensioned state keep said opening closed, and wherein a turn-lock fastener is provided with pulling cables arranged on opposing portions of the turn-lock fastener, wherein the turn-lock fastener is configured to activate or engage the pulling cables when twisted to bring one or more top ends of the spring-loaded profiles and one or more bottom ends of the spring-loaded profiles closer together against a spring force of the spring-loaded profiles, thereby forcing open said opening framed by the spring-loaded profiles.

20. The ski jacket according to claim 19, further comprising an air permeable textile integrated with an inner lining of the two sleeves, wherein the at least one vent is configured to expose the air permeable textile when opened.

* * * * *